US008272245B2

(12) United States Patent
Salamon et al.

(10) Patent No.: US 8,272,245 B2
(45) Date of Patent: Sep. 25, 2012

(54) METHOD FOR SHAPING A BLANK, AND COOLING DEVICE FOR A BLANK

(75) Inventors: Ulrich Salamon, Ubstadt-Weiher (DE); Jens Aspacher, Karlsruhe (DE)

(73) Assignee: Schuler SMG GmbH & Co. KG, Waghäusel (DE)

( * ) Notice: Subject to any disclaimer, the term of this patent is extended or adjusted under 35 U.S.C. 154(b) by 466 days.

(21) Appl. No.: 12/449,747

(22) PCT Filed: Feb. 26, 2008

(86) PCT No.: PCT/EP2008/001501

§ 371 (c)(1), (2), (4) Date: Aug. 25, 2009

(87) PCT Pub. No.: WO2008/104360

PCT Pub. Date: Sep. 4, 2008

(65) Prior Publication Data

US 2010/0095733 A1 Apr. 22, 2010

(30) Foreign Application Priority Data

Mar. 1, 2007 (DE) ..... 10 2007 009 937

(51) Int. Cl.
*B21D 31/00* (2006.01)
*B21D 37/16* (2006.01)

(52) U.S. Cl. ..... 72/364; 72/342.2; 72/342.6

(58) Field of Classification Search ..... 72/342.1–342.8, 72/342.94, 357, 364, 347, 348, 351; 165/86; 432/80, 81, 77

See application file for complete search history.

(56) References Cited

U.S. PATENT DOCUMENTS

| | | | | |
|---|---|---|---|---|
| 3,806,376 | A * | 4/1974 | Toda et al. | 148/505 |
| 3,845,651 | A * | 11/1974 | Vau | 72/357 |
| 2006/0117825 | A1 * | 6/2006 | Pfaffmann et al. | 72/60 |

FOREIGN PATENT DOCUMENTS

| | | |
|---|---|---|
| DE | 103 39 119 | 3/2005 |
| DE | 103 41 867 | 3/2005 |
| EP | 1 462 192 | 9/2004 |
| WO | WO 03/072842 | 9/2003 |

OTHER PUBLICATIONS

English Translation of DE 10341867 A1, Volkswagen, pp. 1-2.*
English Translation of DE 10339119 B3, Benteler, pp. 1-2.*

* cited by examiner

*Primary Examiner* — Teresa M Ekiert
(74) *Attorney, Agent, or Firm* — Paul Vincent

(57) ABSTRACT

When shaping a metal blank (P), the blank (P) is heated to a predetermined temperature, is then cooled using a cooling device (10), and is subsequently placed in a press and is shaped. According to the invention, at least one plate surface, and particularly both plate surfaces, of the blank (P) is/are brought in direct contact with a cooling element (16, 19) in the cooling device (10), and the blank is clamped especially between said cooling elements (16, 19). A corresponding cooling device for a metal blank (P) comprises a first cooling element (16) and a second cooling element (19) which are adjustable relative to each other and between which the blank (P) can be clamped.

16 Claims, 2 Drawing Sheets

METHOD FOR SHAPING A BLANK, AND COOLING DEVICE FOR A BLANK

This application is the national stage of PCT/EP2008/001501 filed on Feb. 26, 2008 and also claims Paris Convention priority of DE 10 2007 009 937.3 filed Mar. 1, 2007.

BACKGROUND OF THE INVENTION

The invention concerns a method for shaping a metal blank, wherein the blank is heated to a predetermined temperature, is then cooled by means of a cooling device, and is subsequently placed in a press and shaped. The invention also concerns a cooling device for a metal blank.

The term "blank" below preferably means flat sheet metal. However, the blank may already be pre-shaped and have a non-flat shape. In the present example, the blank is a flat blank.

In a conventional method that has been used for a long time, a metal blank is inserted into a hydraulic press between an upper tool and a lower tool. The tools are then moved relative to each other, thereby shaping the blank in correspondence with the shapes of the shaping surfaces of the tools.

In the so-called press-hardening method, the blank is initially heated to a temperature of approximately 800° C. to 1000° C. in order to facilitate hardening, is then inserted into the press and shaped, and held in the press under the action of the shaping or pressing force until the blank or the component shaped therefrom has cooled down to a temperature below a predetermined target temperature. Cooling takes a relatively long time. During this time, the press cannot be used further and, for this reason, the production of one single component is very time-consuming and quite uneconomical.

In order to increase the efficiency of the method, the heated blank is conventionally pre-cooled prior to insertion into the shaping press by guiding the blank through a tunnel in which air and/or inert gas is blown towards the blank, thereby cooling it down to a temperature of approximately 400° C. to 500° C. This method considerably reduces the dwell time of the blank or shaped component in the press. However, a corresponding cooling tunnel requires a large amount of space, since the cooling path must be relatively long in order to cool down the components as described above.

It is the underlying purpose of the invention to provide a method for shaping a metal blank, which realizes fast and efficient cooling and shaping of the blank, and to provide a cooling device for a metal blank for performing the method in a simple and space-saving fashion.

SUMMARY OF THE INVENTION

This object is achieved with regard to the method by means of the features of the independent claim. At least one of the blank surfaces and preferably both opposite blank surfaces are thereby brought into direct abutment with a cooling element in the cooling device.

The invention is based on the fundamental idea of cooling the heated blank through direct abutment of cooling elements, i.e. through contact cooling. The heated blank is inserted between the moved-apart cooling elements, whereupon these move towards each other, thereby contacting the blank from opposite sides, preferably over the entire surface, to cool it. It has turned out that direct contact cooling achieves very fast cooling of the blank, and moreover a corresponding cooling device requires a relatively small amount of space.

The cooling device is advantageously structured like a hydraulic locking device that comprises a first, preferably lower cooling element and a second, preferably upper cooling element, which can be adjusted between a closed clamping position and an extended open position by means of a hydraulic drive or adjusting device. The blank is disposed between the cooling elements for cooling and the cooling elements are subsequently moved towards each other to such an extent that the blank is held and preferably clamped between the cooling elements. The clamping force that the cooling elements exert on the blank can thereby be used to shape the blank. In particular, the blank should be plastically pre-formed by means of the clamping force of the cooling elements. Alternatively, the clamping force that the cooling elements exert on the blank may be sufficiently low that the cooling elements do not cause any or, if at all, only elastic shaping of the blank, such that the blank reassumes its original geometrical shape, in particular, a flat blank, after termination of the cooling process.

When the cooling process is finished, the hydraulic adjusting device that holds the cooling element in direct abutment with the plate surfaces of the blank is activated in such a fashion that the cooling elements are moved apart and the blank is removed and can be transferred to a preferably hydraulic press in which the actual shaping process is carried out.

In one feasible embodiment of the cooling process, the user can preselect the clamping force exerted on the blank by the cooling elements and the time period during which the blank shall be clamped between the cooling elements, with the cooling process being carried out accordingly.

However, in a preferred embodiment of the invention, the actual temperature of the blank is detected during the cooling process, and cooling is continued until a predetermined target temperature has been reached or fallen below. The comparison between the actual temperature and the desired or target temperature is usually performed by a control device that terminates the cooling process and moves the cooling elements apart when the target temperature has been reached or fallen below.

In a preferred embodiment of the invention, the actual temperature of the blank is not only detected at one location but simultaneously in various areas of the blank.

In order to ensure defined cooling of the blank, the two plate surfaces of the blank should come into abutment with the respective cooling element, if possible, at the same time. In order to keep the heat transfer at a minimum level prior to the development of the clamping force of the cooling elements, in a further development of the invention, the blank is held between the cooling elements at a separation therefrom prior to start of the cooling process, and comes into abutment with the cooling elements only when the cooling elements are moved towards each other. Towards this end, the cooling device may have adjustable spacers that project in an upward direction, in particular, past the lower cooling element, onto which the blank can be disposed at a separation from the cooling element. When the cooling elements move towards each other and are closed, the upper cooling element exerts pressure on the upper side of the blank, thereby completely inserting the adjustable spacers into the lower cooling element such that the lower side of the blank also comes into abutment with the lower cooling element.

With respect to the cooling device, the above-mentioned object is achieved by a first cooling element and a second cooling element, which can be adjusted with respect to each other and between which the blank can be clamped. The cooling elements are part of a locking device, in particular a hydraulic locking device, and can be moved with respect to each other as described above by means of a hydraulic drive or adjusting device.

At least one of the cooling elements, in particular the lower cooling element, preferably comprises adjustable spacers onto which the blank can be disposed at a separation from the cooling element such that the heated blank only comes into abutment with the lower cooling element immediately before the cooling elements are closed.

When the cooling process is finished, the blank may adhere to the upper cooling element and is also lifted when the cooling elements are moved apart. In order to release the blank from the upper cooling element in this case, ejector pins that can preferably be hydraulically activated may be integrated in the upper cooling element.

In addition to blanks having an at least approximately constant thickness over their surface, there are also conventional blanks having areas of varying thickness over their surface, which are called "tailored blanks" or "patchwork blanks". When blanks of this type are clamped between cooling elements the surfaces of which facing the blank are flat in each case, the blank is in abutment with the cooling elements only in its thicker areas and uniform cooling is thereby not possible. In order to also enable reliable and efficient cooling of a blank with a varying thickness along its surface, in a further development of the invention, each cooling element may be formed from several cooling element parts, wherein the cooling element parts can be adjusted independently of each other. A cooling element may e.g. be formed from 6 to 8 cooling element parts that are disposed next to each other and together form the cooling element. Each cooling element part can be lifted and lowered via a hydraulic drive independently of the other cooling element parts such that the cooling element can be adjusted to the surface contour of the blank to be cooled through corresponding adjustment of the cooling element parts.

Since each cooling element part has its own associated hydraulic drive, the individual cooling element parts may also exert different clamping forces onto the blank by driving the hydraulic drives of the cooling element parts in a different fashion.

In a further development, the temperature of the cooling element parts may also be controlled independently of each other such that different areas of the blank can be exposed to different cooling in order to increase cooling e.g. of the thicker blank areas compared to the thin blank areas to thereby obtain the desired target temperature in the overall blank at approximately the same time.

The term "cooling" means a reduction of the actual temperature of the blank to a desired target temperature. Towards this end, the cooling elements should have an initial temperature that is below the target temperature, wherein the temperature of the cooling elements may be above ambient temperature.

Further details and features of the invention can be extracted from the following description of an embodiment with reference to the drawing.

DESCRIPTION OF THE PREFERRED EMBODIMENT

Figures 1, 2:
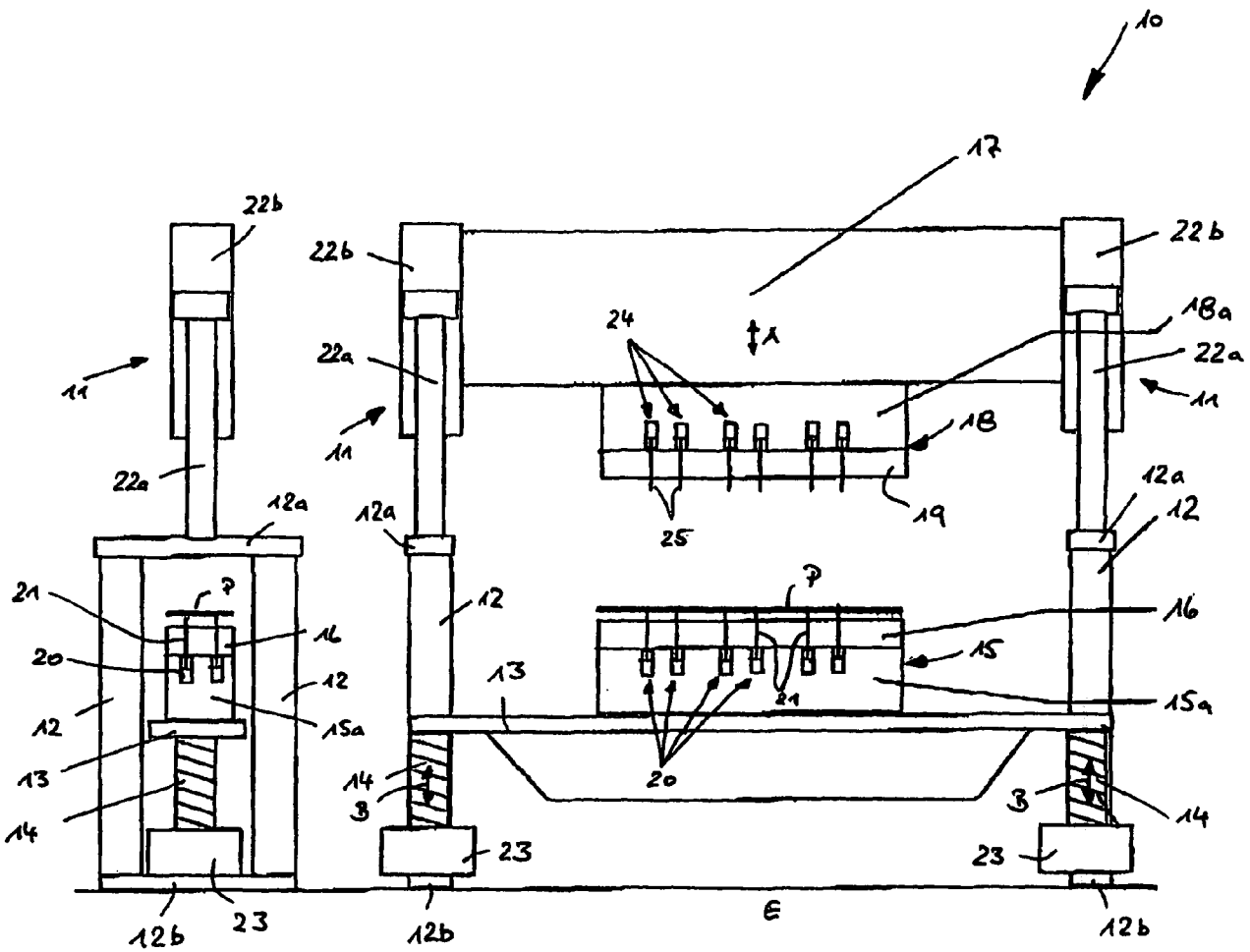
FIG. 1 shows a schematic partially cut-away front view of a cooling device.
FIG. 2 shows a schematic partially cut-away side view of the cooling device in accordance with FIG. 1.

A cooling device 10 shown in FIGS. 1 and 2 comprises four vertical supports 12, each being supported on the ground E and disposed in the corners of a rectangle. Two neighboring supports 12 are connected to each other at their upper and lower ends via transverse bars 12*a* and 12*b* to form a frame. A stationary upwardly projecting piston 22*a* is mounted to the upper side of each upper transverse bar 12*a*, onto the upper end of which a cylinder 22*b* is displaceably disposed. The piston 22*a* and the cylinder 22*b* together form a hydraulic adjusting device 11. The two cylinders 22*b* are firmly connected to each other via a bridge 17. An upper tool 18 is held on the lower side of the bridge 17. The upper tool 18 comprises an upper base plate 18*a* mounted to the bridge 17, on the lower side of which a plate-shaped cooling element 19 is held. A plurality of hydraulic actuating devices 24 in the form of piston-cylinder units are disposed in the base plate 18*a*, each being in contact with one ejector pin 25 that penetrates through the cooling element 19.

A table 13 is disposed in the lower area of the cooling device 10, which is supported between the vertical supports 12 via supports 14, wherein the supports 14 can be adjusted in height by means of an adjusting device 23 as indicated by the double arrows B. A lower tool 15 is provided on the upper side of the table 13 below the upper tool 18, which has a lower base plate 15*a*, on the upper side of which a plate-shaped cooling element 16 is disposed. A plurality of hydraulic actuating devices 20 in the form of piston-cylinder units are integrated in the base plate 15*a*, each of which is connected to one pin-shaped spacer 21 that penetrates through the cooling element 16.

The bridge 17 with the upper tool 18 can be lowered in the direction of the lower tool 15 through activation of the hydraulic adjusting devices 11 to such an extent (see double arrow A) that a flat metal blank P is clamped between the upper tool 18 and the lower tool 15 or between the corresponding cooling elements 19 and 16.

The cooling elements 16 and 19 are cooled in a conventional fashion, in particular, a cooling fluid flows through them.

The mode of operation of the cooling device 10 is explained below. The blank P, being a flat metal plate of constant thickness in the illustrated embodiment, is heated in an upstream station (not shown) to a temperature of approximately 900° C. and subsequently disposed into the cooling device 10 by disposing its lower side on the spacers 21 that project in an upward direction out of the cooling element 16 of the lower tool 15. The blank P is thereby held at a separation from the cooling element 16. This state is shown in FIGS. 1 and 2.

The hydraulic adjusting devices 11 are subsequently activated, thereby lowering the bridge 17 with the upper tool 18 until the cooling element 19 of the upper tool 18 comes into abutment with the upper side of the blank P. The actuating devices 24 of the upper tool 18 are thereby deactivated such that the ejector pins 25 can be inserted into the cooling element 19.

When the upper tool 18 is further lowered, the blank P is pressed from the top onto the upper side of the cooling element 16 of the lower tool 15, thereby inserting the spacers 21 into the cooling element 16. In this closed state of the cooling device 10, the blank P is clamped between the two cooling elements 16 and 19 with little force. The lower side of the cooling element 19 of the upper tool 18 facing the blank P, and the upper side of the cooling element 16 of the lower tool 15 facing the blank P are each flatly designed such that the blank is not deformed, at least not permanently, when the cooling device 10 is closed.

During the cooling process, the actual temperature of the blank P is detected at several locations by means of corresponding sensors, and temperature signals are transmitted to a control device (not shown), which opens the cooling device 10 by lifting the bridge 17 and the upper tool 18 only when the actual temperature is below a predetermined target temperature.

It may happen that the blank P adheres to the lower side of the cooling element 19 of the upper tool 18 when the cooling device 10 is opened, and is lifted therewith. In this case, the actuating devices 24 of the ejector pins 21 are activated, which release the blank P from the upper tool 18.

Figure 3:
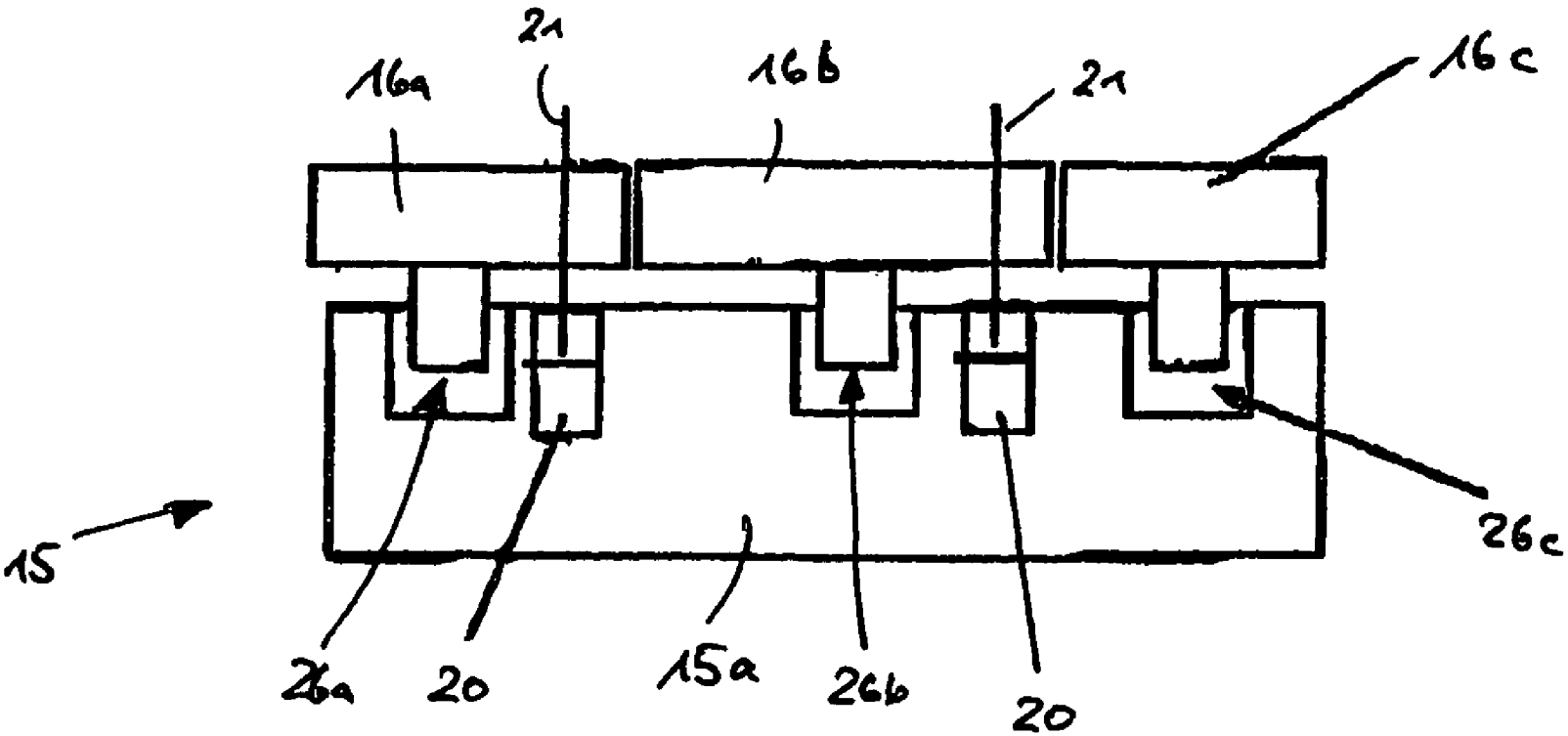
FIG. 3 shows an alternative embodiment of the lower cooling element.

FIG. 1 shows a flat plate P that has a constant thickness over its entire surface. However, there are also conventional blanks with areas of varying thickness. Clamping these blanks using a one-piece flat cooling element would be insufficient. FIG. 3 shows a modification of the lower tool 15, wherein the cooling element 16 is formed from three adjacent cooling element parts 16*a*, 16*b* and 16*c*. Each cooling element part 16*a*, 16*b* and 16*c* is provided with its own hydraulic drive device 26*a*, 26*b* and 26*c*, enabling lifting and lowering of the cooling element parts 16*a*, 16*b* and 16*c* independently of each other. In this fashion, the cooling element parts 16*a*, 16*b*, 16*c* can be adjusted with respect to each other in such a fashion that appropriate clamping can be realized even with a blank having areas of varying thickness.

Although FIG. 3 only shows a modification of the lower tool, the upper tool may alternatively or additionally be formed in the same fashion by designing its cooling element 19 in the form of several cooling element parts each having its own hydraulic drive device.

In FIG. 3, the cooling element 16 is divided into three cooling element parts 16*a*, 16*b*, and 16*c*. The cooling element can also be divided into more cooling element parts, wherein a division into 6 to 8 cooling elements parts has turned out to be useful, which are disposed in a field of 2×3 or 2×4.

The height adjustment of the table 13 and thereby of the lower tool 15 is used to adjust the position of the upper edge of the lower tool to the transport height of automatic relocating devices, e.g. gripper devices or robots.

We claim:

1. A method for shaping a metal blank, the blank having two opposite fiat surfaces, the method comprising the steps of:

a) heating the blank to a predetermined temperature;

b) bringing, following step a), the two flat surfaces into direct contact with a first and a second cooling element in a cooling device, thereby cooling the blank, the second cooling element being adjusted with respect to the first cooling element to clamp the blank between the first and the second cooling elements, each of the first and said second cooling elements having several cooling element parts which are structured for adjustment, independently of each other;

c) inserting, following step b), the blank into a press; and d) shaping the blank during step c).

2. The method of claim 1, wherein an overall surface of the blank is in abutment with the cooling element.

3. The method of claim 1, wherein the blank is shaped by means of the two cooling elements.

4. The method of claim 3, wherein a clamping force of the cooling elements only causes elastic shaping of the blank.

5. The method of claim 1, wherein the two cooling elements are clamped with respect to each other by means of a hydraulic adjusting device.

6. The method of claim 1, wherein an actual temperature of the blank is detected during cooling and cooling is continued until a predetermined target temperature is reached or fallen below.

7. The method of claim 6, wherein the actual temperature of the blank is detected simultaneously in different areas of the blank.

8. The method of claim 1, wherein the blank is held between the two cooling elements at a separation therefrom prior to start of a cooling process, and is brought into abutment with the two cooling elements when they are moved towards each other.

9. The method of claim 1, wherein the blank is heated to a temperature of 800° C. to 1000° C.

10. The method of claim 1, wherein the blank is cooled down to a temperature of 400° C. to 500° C.

11. A cooling device for a metal blank the device comprising:

a first cooling element; and a second cooling element which can be adjusted with respect to said first cooling element, wherein the blank can be clamped between said first and said second cooling elements, each of said first and said second cooling elements being formed from several cooling element parts, wherein said cooling elements parts are structured for adjustment, independently of each other.

12. The cooling device of claim 11, wherein said first and said second cooling elements can be hydraulically adjusted.

13. The cooling device of claim 11, wherein at least one of said first and said second cooling elements has adjustable spacers onto which the blank can be disposed at a separation from a respective said first or said second cooling element.

14. The cooling device of claim 11, further comprising at least one temperature sensor that can detect an actual temperature of the blank during a cooling process.

15. The cooling device of claim 11, wherein said cooling element parts can introduce different clamping forces into the blank.

16. The cooling device of claim 11, wherein a temperature of said cooling element parts can be adjusted independently of each other.

* * * * *